United States Patent [19]

Ratajac et al.

[11] Patent Number: 5,040,791

[45] Date of Patent: Aug. 20, 1991

[54] BATTING CAGE

[76] Inventors: Aleksandar Ratajac, 1333 Thomas Ave., Apt. 16, San Diego, Calif. 92109; Jean C. Langlois, 7515 Charmant Dr., #1401, San Diego, Calif. 92122; Gary Dubie, 9823 Pacific Heights Blvd., #T, San Diego, Calif. 92121; Bobby Ratayats, 1779 Peters Road, Vancover, B.C., Canada, V7J 1Y7

[21] Appl. No.: 325,902

[22] Filed: Mar. 20, 1989

[51] Int. Cl.[5] ..... A63B 69/00

[52] U.S. Cl. ..... 273/26 E; 273/26 R; 273/29 A; 273/319; 273/413

[58] Field of Search ..... 273/25, 26 R, 26 A, 273/26 E, 26 EA, 29 R, 29 A, 181 F, 184 B, 196 R, 200 R, 319, 413, 58 R, 58 A, 58 BA, 58 C

[56] References Cited

U.S. PATENT DOCUMENTS

| | | | |
|---|---|---|---|
| 1,554,409 | 9/1925 | Coffee | 273/26 E |
| 2,839,300 | 6/1958 | Blaha et al. | 273/26 E |
| 3,310,306 | 3/1967 | Burt | 273/26 E |
| 3,442,510 | 5/1969 | Sorensen | 273/26 E |
| 4,027,880 | 6/1977 | Hadtke | 273/29 A |
| 4,521,016 | 6/1985 | Tominaga | 237/29 A |
| 4,735,413 | 4/1988 | Yamanouchi et al. | 273/26 E |

*Primary Examiner*—Edward M. Coven
*Assistant Examiner*—Raleigh W. Chiu
*Attorney, Agent, or Firm*—Charles C. Logan, II

[57] ABSTRACT

A collapsible portable batting cage having an upper frame assembly, a lower frame assembly, and a rear frame assembly. A length of shock cord is threaded through a vertical bore hole. The top end of the shock cord passes through an eye bolt on the front end of the upper frame assembly and its free end is detachably secured to the top edge of the rear assembly. The bottom end of the shock cord is passed through an eye bolt mounted on the front end of the lower frame assembly and it has its free end detachably secured to the bottom edge of the rear assembly. There is structure on the respective top edge and bottom edge of the rear frame assembly for adjusting the height of the static position of the ball prior to a person taking practice batting swings against it. A safety line is passed through the horizontal bore hole of the bail and its respective ends are secured to the left and right upright tubular members of the rear frame assembly. The batting cage is both portable due to the nature of its light weight components and it is also collapsible which allows it to be stored or carried in a compact manner.

9 Claims, 1 Drawing Sheet

BATTING CAGE

BACKGROUND OF THE INVENTION

The invention relates to a baseball and softball and more specifically to a collapsible portable cage that can be used to practice and improve ones hitting.

In the past the most common method of improving ones batting stroke or swing was to bat against live pitchers or against a pitching machine. This usually meant that several ball players were standing around waiting for their turn to bat. Also there are occasions when it would be highly desirable for a player to take practice swings against a baseball during the time prior to going to bat.

Some attempts have been made to design devices that could be swung at with a bat but these have only had a single rope or cord tethered to a ball. After being hit, the ball continues to circle around and around until it loses its speed or the cord wraps itself around the support structure. The time taken to reset the ball in order to take another swing is generally prolonged. Also, most of these devices do not have structure which allows the height of the baseball's static position to be quickly and easily adjusted.

It is an object of the invention to provide a novel collapsible portable batting cage that will allow baseball players to take practice swings at a baseball between innings of a game.

It is also an object of the invention to provide a novel collapsible portable cage that will allow ball players to increase their batting skills.

It is another object of the invention to provide a novel collapsible portable batting cage that is economical to manufacture and market.

It is an additional object of the invention to provide a novel collapsible portable batting cage that is assembled from light weight components that are quickly and easily disassembled and assembled.

SUMMARY OF THE INVENTION

Applicant's novel batting cage has been designed so that it is made of components that are easily and quickly assembled and disassembled. These components are tubular and they are made of light weight material. The telescoping ends of the frame components are secured together by bolts and nuts. Since the batting cage is collapsible, it can be stored and carried in a small container.

The batting cage has a framework structure having an upper frame assembly, a lower frame assembly and a rear frame assembly. The upper and lower frame assemblies are both horizontally oriented and vertically spaced from each other a predetermined height. The rear end of the upper and lower frame assemblies are secured to the rear frame assembly. A net is stretched across and it is attached to the rear frame assembly to cushion the force of the baseball hit toward the rear frame assembly.

In a preferred embodiment of the batting cage, ten tubular members are assembled together with their respective ends telescopically mating with each other. These components are two top corners, two bottom corners, a V-shaped top front end and a V-shaped bottom front end, and a pair of two part brace assemblies.

The baseball or softball used with the batting cage has a vertically oriented bore hole passing from its top surface to its bottom surface. It also has a horizontally oriented bore hole passing from its left side to its right side. A length of shock cord having a diameter in the order of ⅛ of an inch passes downwardly through the vertical bore hole of the baseball. The top end of the shock cord passes through an eye bolt extending downwardly from the top front end of the upper frame assembly. This end of the shock cord then passes through an eye bolt secured to the top edge of the rear frame assembly. Since this end of the shock cord has a hook on its end, this hook may be placed in any of the laterally spaced apertures in the top frame member. This allows the height of the static position of the baseball to be adjusted upwardly and downwardly. The bottom end of the shock cord passes through a similar type of structure in the nature of an eye bolt secured to the bottom front end of the lower frame assembly and then through an eye bolt attached to the bottom edge of the rear frame assembly. Knots are formed in the shock cord adjacent the top surface and bottom surface of the baseball to secure its position.

A safety line having its opposite ends attached to the respective left and right upright members of the rear frame assembly passes through the horizontal bore hole of the baseball. A pair of plastic tube sleeves surround the safety line on both sides of the baseball and these are held in their desired positions by knots formed in the safety line at the front and rear ends of the plastic tube sleeves. The safety line helps to control the travel of the baseball after it has been hit so that it will stay within the confines of the collapsible portable batting cage. The plastic tube sleeves prevent the ball from becoming entangled in the safety line after it has been hit.

DESCRIPTION OF THE PREFERRED EMBODIMENT

Figure 1:
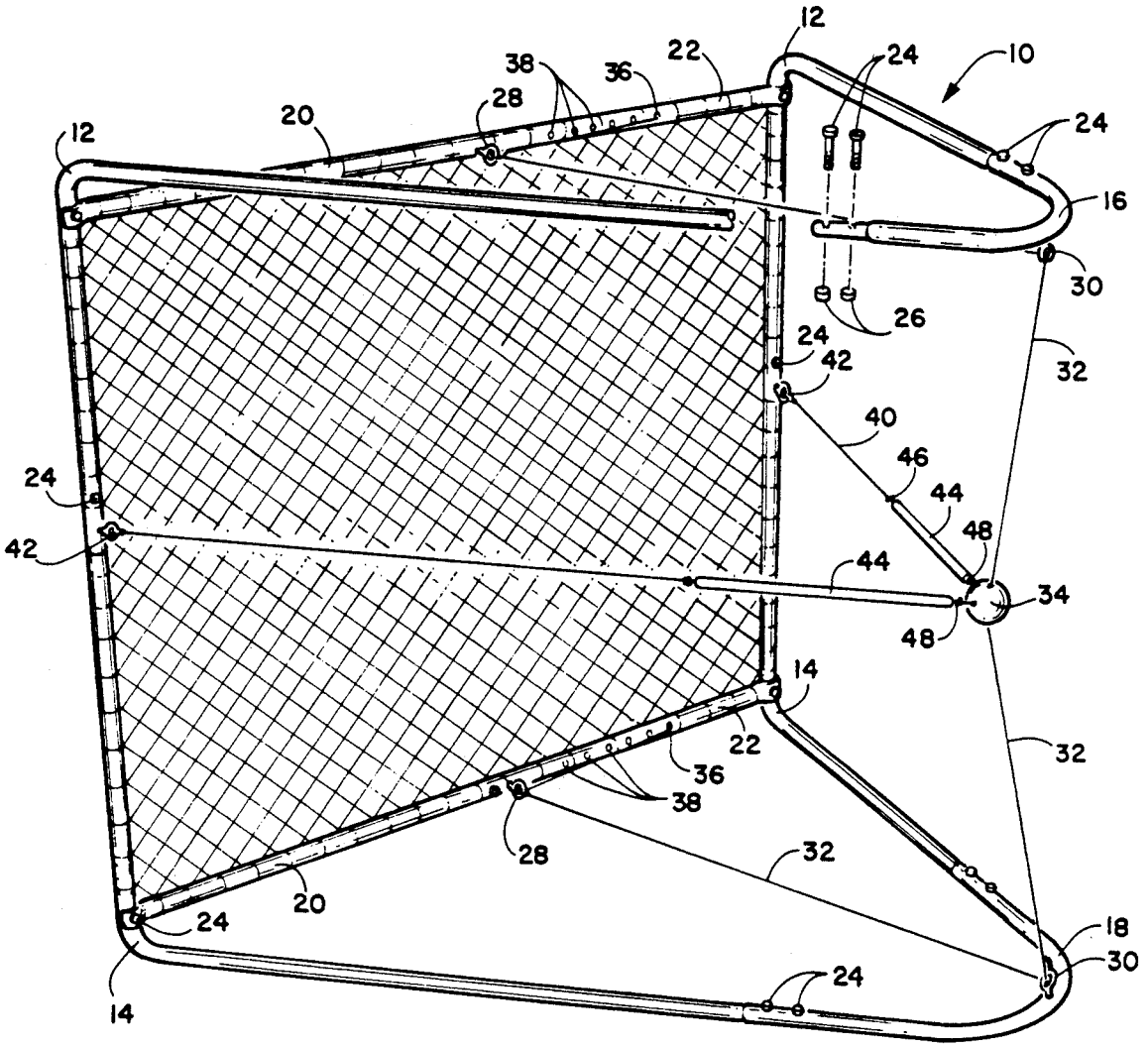
FIG. 1 is a front perspective view of applicant's novel collapsible portable batting cage.

Applicant's novel collapsible portable batting cage will now be described by referring to FIGS. 1 and 2 of the drawing. The batting cage is generally designated numeral 10.

The frame of the batting cage is formed from right angle shaped top corners 12, right angle shaped bottom corners 14, and substantially v-shaped top front end 16 and bottom front end 18. A pair of horizontally oriented brace assemblies are formed of left hand brace member 20 and right hand brace member 22. As seen in FIG. 1, the different members telescopically mate with each other and bolts 24 passing through apertures in the components have locking nuts 26 to securely fasten them together.

Eye bolts 28 are secured to the respective brace assemblies and eye bolts 30 are secured to the respective top front end 16 and the bottom front end 18. A shock cord 32 passes through baseball or softball 34 and threads through the respective eye bolts 30 and 28. A hook 36 formed on the free ends of shock cord 32 is detachably inserted into any of the apertures 38 in the respective brace assemblies. A safety line 40 passes through baseball 34 and it has its opposite ends secured to eye bolts 42 that are secured to the respective left and right side upright members of the rear frame assembly.

The horizontal portions of the top corners 12 and top front end 16 form the upper frame assembly. The horizontal portions of the bottom corners 14 and bottom front end 18 form the lower frame assembly.

Safety line 40 also passes through plastic tube sleeves 44 and they are maintained in their desired positions thereon by knots 46 and 48.

Figure 2:
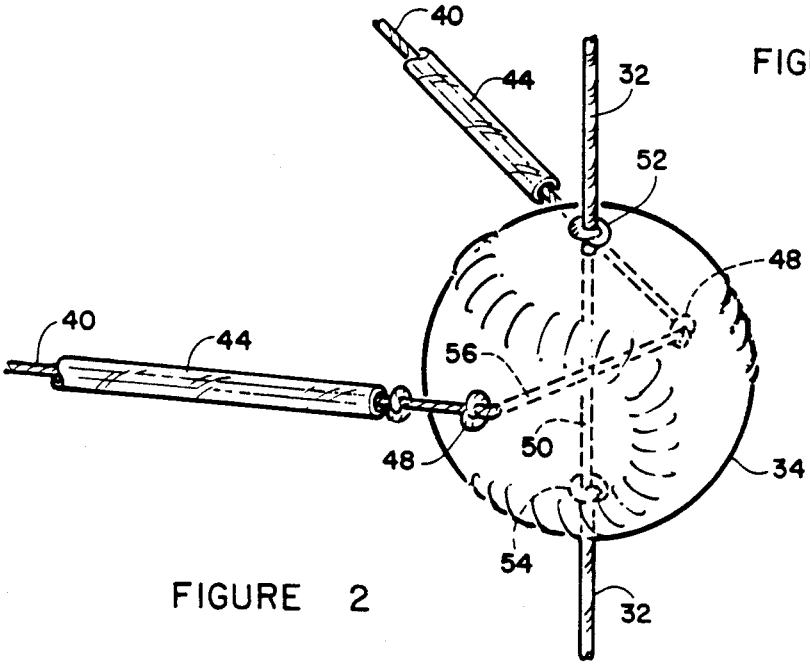
FIG. 2 is a front perspective view of the novel baseball or softball that is used with the batting cage and it shows the manner in which it is secured by the shock cord and the safety line.

The structure of baseball or softball 44 and the manner in which it is secured to shock cord 32 and safety line 40 is best described by referring to FIG. 2. A vertical bore hole 50 extends from the top surface of the baseball to the bottom surface thereof. A knot 52 is formed at its top end and a knot 54 is formed at its bottom end. A horizontally oriented bore hole 56 passes from the left side of the baseball completely through to the right side of the baseball. Knots 48 are formed in safety line 40 adjacent the surface of the baseball.

What is claimed is:

1. A collapsible portable batting cage comprising:

a ball having a top side, a bottom side, a front side, a rear side, a left side and a right side;

a first length of shock cord having a top end and a bottom end, said bottom end being connected to the top side of said ball;

a second length of shock cord having a top end and a bottom end, said top end being connected to the bottom side of said ball;

an upright oriented rear frame assembly comprising a pair of laterally spaced upright oriented elongated side frame members each having a top end and a bottom end, a substantially horizontally oriented elongated top cross member having its opposite ends connected to the top ends of said respective side frame members, a substantially horizontally oriented elongated bottom cross member having its opposite ends connected to the bottom ends of said respective side frame members, said rear frame assembly having a front end;

a net stretched across and filling the interior area of said rear frame assembly from its top cross member to its bottom cross member and also from one side frame to the other side frame member, said net being secured to said rear frame assembly to cushion the force of the ball hit toward the front end of said rear frame assembly;

an upper frame assembly having a front end and a rear end, the rear end of said upper frame assembly being connected to said rear frame assembly adjacent its top end and it extends forwardly in a cantilevered orientation;

a lower frame assembly having a front end and a rear end, the rear end of said lower frame assembly being connected to said rear frame assembly adjacent its bottom end and it extends forwardly therefrom to form a support structure for the batting cage;

a first ring-like structure secured to the front end of said upper frame assembly through which the top end of said first length of shock cord is threaded so that an upward tension can be applied to said ball causing it to be suspended at a predetermined height in space;

a second ring-like structure secured to the front end of said lower frame assembly through which the bottom end of said second length of shock cord is threaded so that a downward tension can be applied to said ball causing it to be suspended at a predetermined height in space;

first attachment means for detachably securing the top end of said first length of shock cord at one of several multiple positions on the horizontally oriented elongated top cross member of said upright oriented rear frame assembly so that an upward tension can be applied to said ball causing it to be suspended at different predetermined static heights in space;

second attachment means for detachably securing the bottom end of said second length of shock cord at one of several multiple positions on the horizontally oriented elongated bottom cross member of said upright oriented rear frame assembly so that a downward tension can be applied to said ball so that a static position may be maintained prior the ball being hit with a bat and the first and second length of shock cord will cause the ball to automatically be returned to said static position after it has been struck by a bat; and a right safety line and a left safety line connecting the respective right and left sides of the ball to the respective right and left upright oriented side frame members of said rear frame assembly, said safety line being oriented in a substantially horizontal plane.

2. A collapsible portable batting cage as recited in claim 1 wherein said ball is a baseball.

3. A collapsible portable batting cage as recited in claim 2 wherein said baseball has a vertically oriented bore hole passing through it from its top surface to its bottom surface.

4. A collapsible portable batting cage as recited in claim 3 wherein said first and second length of shock cord are integrally formed from a single length of shock cord and there are means for preventing said ball from sliding upwardly or downwardly along said single length of shock cord.

5. A collapsible portable batting cage as recited in claim 1 wherein said ball has a horizontally oriented bore hole passing through it from its left side to its right side and said safety line means comprises a single length of safety line passing through said horizontally oriented bore hole.

6. A collapsible portable batting cage as recited in claim 5 wherein said safety line has means for preventing the ball from sliding laterally right or left along said safety line.

7. A collapsible portable batting cage as recited in claim wherein said means for preventing the ball from sliding laterally is a knot in said safety line adjacent the left side of said ball and a knot in said safety line adjacent the right side of said ball.

8. A collapsible portable batting cage as recited in claim 5 further comprising a pair of plastic tube sleeves, one being on said safety line on each side of said ball for preventing entanglement of the ball, the shock cord and the safety line after the ball has been hit.

9. A collapsible portable batting cage comprising:

a ball having a top side, a bottom side, a front side, a rear side, a left side and a right side:

a first length of shock cord having a top end and a bottom end, said bottom end being connected to the top side of said ball;

a second length of shock cord having a top end and a bottom end, said top end being connected to the bottom side of said ball;

an upright oriented rear frame assembly comprising a pair of laterally spaced upright oriented elongated side frame members each having a top end and a bottom end, a substantially horizontally oriented elongated top cross member having its opposite ends connected to the top ends of said respective side frame members, a substantially horizontally oriented elongated bottom cross member having its opposite ends connected to the bottom ends of said respective side frame members, said rear frame assembly having a front end;

a net stretched across and filling the interior area of said rear frame assembly from its top cross member to its bottom cross member and also from one side frame member to the other frame member, said net being secured to said rear frame assembly to cushion the force of the ball hit toward the front end of said rear frame assembly;

an upper frame assembly having a front end and a rear end, the rear end of said upper frame assembly being connected to said frame assembly adjacent its top end and it extends forwardly in a cantilevered orientation;

a lower frame assembly having a front end and a rear end, the rear end of said lower frame assembly being connected to said rear frame assembly adjacent its bottom end and it extends forwardly therefrom to form a support structure for the batting cage;

means adjacent the front end of said upper frame assembly through which the top end of said first length of shock cord may be threaded so that an upward tension can be applied to said ball causing it to be suspended at a predetermined height in space;

means adjacent the front end of said lower frame assembly through which the bottom end of said second length of shock cord may be threaded so that a downward tension can be applied to said ball causing it to be suspended at a predetermined height in space;

means on said horizontally oriented elongated top cross member to which the bottom end of said first of shock cord can be secured to raise or lower the static height of said ball;

means on said horizontally oriented elongated bottom cross member to which the bottom end of second length of shock cord can be secured to raise and lower the static height of said ball; and a right safety line and a left safety line connecting the respective right and left sides of the ball to the respective right and left upright oriented side frame members of said rear frame assembly, said safety lines being oriented in a substantially horizontal plane, the length of said respective safety lines being such that they control the travel of the ball affer it has been hit so that it will stay within the confines of the rear frame assembly, the upper frame assembly, and the lower frame assembly of the collapsible portable batting cage.

* * * * *